US005501810A

United States Patent [19]

Eugster et al.

[11] Patent Number: 5,501,810

[45] Date of Patent: Mar. 26, 1996

[54] PROCESS FOR INCREASING THE APPARENT DENSITY OF SPRAY-DRIED DETERGENTS

[75] Inventors: Hans Eugster, Pratteln, Switzerland; Herbert Reuter, Haan, Germany; Beat Buser, Moehlin, Switzerland

[73] Assignee: Henkel Kommanditgesellschaft auf Aktien, Duesseldorf, Germany

[21] Appl. No.: 318,696

[22] PCT Filed: Mar. 31, 1993

[86] PCT No.: PCT/EP93/00775

§ 371 Date: Dec. 9, 1994

§ 102(e) Date: Dec. 9, 1994

[87] PCT Pub. No.: WO93/21300

PCT Pub. Date: Oct. 28, 1993

[30] Foreign Application Priority Data

Apr. 8, 1992 [DE] Germany ..... 42 11 699.6

[51] Int. Cl.[6] ..... C11D 11/00; C11D 17/06

[52] U.S. Cl. ..... 252/89.1; 252/91; 252/174; 252/174.13; 252/135

[58] Field of Search ..... 252/90, 91, 89.1, 252/174, 174.13, 174.21, 135

[56] References Cited

U.S. PATENT DOCUMENTS

| | | | |
|---|---|---|---|
| 3,886,098 | 5/1975 | DiSalvo et al. | 252/540 |
| 3,966,629 | 6/1976 | Dumbrell | 252/140 |
| 4,144,226 | 3/1979 | Crutchfield et al. | 528/231 |
| 4,146,495 | 3/1979 | Crutchfield et al. | 252/89 R |
| 4,207,197 | 6/1980 | Davis et al. | 252/99 |
| 4,457,854 | 7/1984 | Gangwisch et al. | 252/91 |
| 4,737,306 | 4/1988 | Wichelhaus et al. | 252/95 |
| 4,931,203 | 6/1990 | Ahmed et al. | 252/99 |
| 4,965,015 | 10/1990 | Heybourne et al. | 252/174.25 |
| 4,996,001 | 2/1991 | Ertle et al. | 252/99 |
| 5,149,455 | 9/1992 | Jacobs et al. | 252/174.13 |
| 5,281,351 | 1/1994 | Romeo et al. | 252/99 |

FOREIGN PATENT DOCUMENTS

| | | |
|---|---|---|
| 0025551 | 3/1981 | European Pat. Off. . |
| 0026529 | 4/1981 | European Pat. Off. . |
| 0270240 | 6/1988 | European Pat. Off. . |
| 0337330 | 10/1989 | European Pat. Off. . |
| 0390251 | 10/1990 | European Pat. Off. . |
| 0451894 | 10/1991 | European Pat. Off. . |
| 2334899 | 1/1974 | Germany . |
| 3526405 | 7/1985 | Germany . |
| 2005715 | 4/1979 | United Kingdom . |

*Primary Examiner*—Paul Lieberman
*Assistant Examiner*—Lorna M. Douyon
*Attorney, Agent, or Firm*—Ernest G. Szoke; Wayne C. Jaeschke; Real J. Grandmaison

[57] ABSTRACT

A process for increasing the apparent density of spray-dried detergents comprising spraying the spray-dried detergents with both a liquid nonionic surfactant and an aqueous solution of an alkali metal silicate either simultaneously or in successive steps, and mixing the resultant mixture.

12 Claims, No Drawings

PROCESS FOR INCREASING THE APPARENT DENSITY OF SPRAY-DRIED DETERGENTS

BACKGROUND OF THE INVENTION AND FIELD OF THE INVENTION

This invention relates to a process for the production of granular detergents which are primarily intended for washing laundry.

DISCUSSION OF THE RELATED ART

Detergents, above all those intended for use in the home, are generally marketed not as mixtures of their constituents, but rather in the form of granular preparations in which all the constituents or the majority of constituents are present in the form of an intimate mixture in the individual particles. This form has various advantages in the practical application of the detergents, of which only the substantial absence of dust and the safeness against separation during transport are mentioned here. Granular detergents of the type in question can be produced in various ways. Thus, processes are known in which the individual constituents of the detergents are converted into the granular form by compacting granulation, for example using extruders. There are also processes in which the fine-particle constituents are agglomerated to form relatively large particles with the aid of liquids, for example alkali metal silicate solutions (U.S. Pat. No. 4,207,197, U.S. Pat. No. 4,996,001). For various technical reasons, the process of spray drying has long been preferred for the continuous production of relatively large quantities of granular detergents. In this process, which is carried out in large towers, an aqueous slurry of the detergent ingredients is dried in free fall by hot gases to form granular products. Apart from the fact that they are easy to produce in large quantities, these products also have various applicational advantages over detergents produced by other methods. However, it has recently been found to be a disadvantage that granular detergents produced by spray drying generally have only low apparent densities of rarely more than 550 g/l because this necessitates relatively large containers and a large amount of packaging material. Accordingly, increasing efforts have been made in recent years to find ways of retaining the advantages of spray drying while at the same time increasing the apparent densities of the spray-dried products. For example, it is proposed in European patent application 337 330 to spray the spray-dried granular detergents with nonionic surfactants in a high-speed mixer. The increase in apparent density is dependent upon the quantity of nonionic surfactant applied and is remarkably large when the tower powder used is very light. Unfortunately, a disadvantage of this approach is that, when relatively large quantities of nonionic surfactants are applied, the products obtained show poor flow properties or are tacky so that increases in apparent density by this method are limited.

The problem addressed by the present invention was also to produce a spray-dried detergent of relatively high apparent density by a process which would not be attended by any of the disadvantages of known processes.

DESCRIPTION OF THE INVENTION

The present invention relates to a process for increasing the apparent density of spray-dried detergents in which the spray-dried granular material is simultaneously or successively sprayed in a mixing unit with a liquid nonionic surfactant and an aqueous solution of an alkali metal silicate.

This process is preferably carried out in a mixing unit comprising a horizontally mounted cylindrical mixing drum in which mixing tools rotate on a horizontal shaft.

The process according to the invention is distinguished from known processes by the fact that the use of silicate solution makes it possible to obtain a further increase in apparent density without the particles formed becoming tacky. Surprisingly, the granular detergent flows freely immediately after leaving the mixing unit without any need for a separate drying step.

The process according to the invention is suitable for spray-dried detergents of any composition, although it is preferably carried out with detergent tower powders which already have a relatively high apparent density. In a particularly preferred embodiment, the process according to the invention is applied to detergent tower powders which contain little or no phosphate and in which sodium aluminium silicate in the form of zeolite is present as the principal builder.

Preferably, 4 to 20% by weight of the tower powder consists of at least one anionic surfactant, 15 to 70% by weight of at least one builder, 0 to 10% by weight of nonionic surfactants and 0 to 60% by weight of other detergent ingredients which lend themselves to spray drying at elevated temperature.

The anionic surfactants present in the tower powder are preferably anionic surfactants from the classes of soaps, sulfonates and sulfates. Suitable soaps are derived from natural or synthetic, saturated or monounsaturated fatty acids containing 12 to 22 carbon atoms. Particularly suitable anionic surfactants are soap mixtures derived from natural fatty acids, for example coconut oil, palm kernel oil or tallow fatty acids. Soap mixtures of which 50 to 100% consist of saturated $C_{12-18}$ fatty acid soaps and 0 to 50% of oleic acid soap are preferred. In a preferred embodiment, they make up from 0.5 to 5% by weight of the tower powder.

Useful surfactants of the sulfonate type are linear alkyl benzenesulfonates ($C_{9-13}$ alkyl) and olefin sulfonates, i.e. mixtures of alkene and hydroxyalkanesulfonates, and also the disulfonates obtained, for example, from $C_{12-18}$ monoolefins with a terminal or internal double bond by sulfonation with gaseous sulfur trioxide and subsequent alkaline hydrolysis of the sulfonation products. Other suitable surfactants of the sulfonate type are alkanesulfonates obtainable from $C_{12-18}$ alkanes by sulfochlorination or sulfoxidation and subsequent hydrolysis or neutralization and α-sulfonated hydrogenated coconut oil, palm kernel oil or tallow fatty acids and methyl or ethyl esters thereof and mixtures thereof. Sulfosuccinic acid esters preferably containing 8 to 16 carbon atoms in the alcohol groups are also suitable.

Suitable surfactants of the sulfate type are the sulfuric acid monoesters of long-chain alcohols of natural and synthetic origin, i.e. of fatty alcohols, such as for example coconut oil fatty alcohols, tallow fatty alcohols, oleyl alcohol, lauryl, myristyl, palmityl or stearyl alcohol, or $C_{10-18}$ oxoalcohols and the sulfuric acid esters of secondary alcohols with the same chain length. Sulfuric acid monoesters of primary alcohols or alkylphenols ethoxylated with 1 to 3 moles of ethylene oxide are also suitable, as are sulfated fatty acid alkanolamides and sulfated fatty acid monoglycerides.

Alkyl benzenesulfonates and fatty alcohol sulfates are preferably used as the anionic surfactants. The anionic surfactants are typically present in the form of their sodium salts and preferably make up from 5 to 15% by weight of the tower powder.

Nonionic surfactants may be totally absent from the tower powder and need only be added to the final detergent in the subsequent mixing process. Preferably, however, the tower powder already contains a small proportion of these surfactants, more particularly from 0.5 to 5% by weight.

Suitable nonionic surfactants are adducts of 2 to 20 moles and preferably 3 to 15 moles of ethylene oxide (EO) with 1 mole of a long-chain compound essentially containing 10 to 20 carbon atoms and more particularly 12 to 18 carbon atoms, preferably from the group of alcohols. Suitable nonionic surfactants are derived in particular from primary alcohols, for example coconut oil or tallow fatty alcohol, oleyl alcohol, or from secondary alcohols containing 8 to 18 and preferably 12 to 18 carbon atoms. Combinations of water-soluble nonionic surfactants and water-insoluble or water-dispersible nonionic surfactants are preferably used. The former include those containing 6 to 15 EO or having an HLB value of more than 11 while the latter include those containing 2 to 6 EO or having an HLB value of 11 or less. It has proved to be of advantage fully to incorporate the less soluble ethoxylates in the already spray-dried powder in the mixer. The other part may be both completely or partly co-sprayed and also completely or partly added in the mixer.

The nonionic surfactants may also contain propylene glycol ether groups (PO). These PO groups may be terminally arranged or statistically distributed with the EO groups. Preferred compounds of this class correspond to the formula $R\text{-}(PO)_x\text{-}(EO)_y$, where R is the hydrophobic component, x has a value of 0.5 to 3 and y has a value of 3 to 20.

Other suitable nonionic surfactants are ethoxylates of alkylphenols, 1,2-diols, fatty acids and fatty acid amides and also block polymers of polypropylene glycol and polyethylene glycol or alkoxylated alkylenediamines (of the Pluronics and Tetronics type). The nonionic surfactants of the EO type described above may also be partly replaced by alkyl polyglycosides. Suitable alkyl polyglycosides contain, for example, a $C_{8-16}$ alkyl group and an oligomeric glycoside unit with 1 to 6 glucose groups. Surfactants of the alkyl glycoside type are preferably incorporated in the spray-dried powder.

The content of nonionic surfactants or nonionic surfactant mixtures in the final detergent is from 2 to 15% by weight, preferably from 3 to 12% by weight and more preferably from 4 to 10% by weight.

The builder component of the tower powder preferably consists predominantly of finely crystalline, synthetic water-containing zeolites of the NaA type which have a calcium binding capacity of 100 to 200 mg CaO/g (as determined accordance with DE 22 24 837). Their particle size is typically in the range from 1 to 10 μm. The content of these zeolites in the tower powder is preferably from 10 to 50% by weight and more preferably from 15 to 35% by weight.

The zeolite is preferably used together with polyanionic co-builders which include compounds from the class of polyphosphonic acids and also homopolymeric and copolymeric polycarboxylic acids derived from acrylic acid, methacrylic acid, maleic acid and olefinically unsaturated copolymerizable compounds.

Preferred phosphonic acids or phosphonic acid salts are 1-hydroxyethane-1,1-diphosphonate, ethylenediamine tetramethylene phosphonate (EDTMP) and diethylenetriamine pentamethylene phosphonate, generally in the form of their sodium salts, and mixtures thereof. The quantities used, expressed as free acid, are normally up to 1.5% by weight, based on the tower powder, and preferably from 0.1 to 0.8% by weight.

Other suitable co-builders are aminopolycarboxylic acids, more particularly nitrilotriacetic acid, also ethylenediamine tetraacetic acid, diethylenetriamine pentaacetic acid and higher homologs thereof. They are generally present in the form of the sodium salts. Their percentage content may be up to 2% by weight and, in the case of nitrilotriacetic acid, up to 10% by weight.

Other useful co-builders are homopolymers of acrylic acid and methacrylic acid, copolymers of acrylic acid with methacrylic acid and copolymers of acrylic acid, methacrylic acid or maleic acid with vinyl ethers, such as vinylmethyl ether or vinylethyl ether; with vinyl esters, such as vinyl acetate or vinyl propionate; acrylamide, methacrylamide and with ethylene, propylene or styrene. In copolymeric acids such as these, where one of the components does not have an acid function, their percentage content in the interests of adequate solubility in water is no more than 70 mole-% and preferably less than 60 mole-%. Copolymers of acrylic acid or methacrylic acid with maleic acid of the type characterized, for example, in EP 25 551 have proved to be particularly suitable. The copolymers in question contain 50 to 90% by weight of (meth)acrylic acid. Particularly preferred copolymers contain 60 to 85% by weight of acrylic acid and 40 to 15% by weight of maleic acid and have a molecular weight of 30,000 to 120,000.

Other suitable co-builders are polyacetal carboxylic acids, for example of the type described in U.S. Pat. Nos. 4,144,226 and 4,146,495, which are obtained by polymerization of esters of glycolic acid, introduction of stable terminal groups and saponification to the sodium or potassium salts. Polymeric acids obtained by polymerization of acrolein and Canizzaro disproportionation of the polymer with strong alkalis are also suitable. Polymeric acids such as these are essentially made up of acrylic acid units and vinyl alcohol units or acrolein units.

The percentage content of (co)polymeric carboxylic acids or their salts may be up to 8% by weight and is preferably from 1 to 8% by weight, based on acid.

By virtue of their complexing and precipitation-retarding properties (so-called threshold effect), the co-builders mentioned prevent the formation of fiber incrustations and improve the soil-dissolving and soil-dispersing properties of the detergents.

The detergents are preferably phosphate-free. However, in cases where this is ecologically safe or permitted, the builder component of the detergent may also consist partly of polyphosphates, more particularly pentasodium triphosphate (Na-TPP). However, the Na-TPP content should be no more than 25% by weight and is preferably less than 20% by weight and, more preferably, from 0 to at most 5% by weight, based on the tower powder.

The so-called washing alkalis are also included among the co-builders.

Suitable washing alkalis are primarily the alkali metal silicates, more particularly sodium silicates with the composition $Na_2OSiO_2$=1:1 to 1:3.5 and preferably 1:2 to 1:3.35. In a preferred embodiment, they make up no more than 5% by weight and, in particular, from 1 to 3% by weight of the tower powder. Their percentage content in the final detergent may be higher, for example from 1 to 15% by weight. The sodium silicate improves the particle stability and particle structure of the powder-form or granular detergents and has a favorable effect on the dispensing and dissolving behavior of the detergents where they are used in automatic washing machines. In addition, it has an anticorrosive effect and improves detergency. Although it is known that relatively large amounts, i.e. more than 2 to 3% by weight, of alkali metal silicates in zeolite-containing detergents lead to agglomeration of the zeolite particles which thus settle on the fabrics, increase their ash value and can adversely affect their appearance, this harmful influence is largely eliminated where other co-builders, especially (co)polymeric carboxylic acids, are present, in addition to which the sodium silicate content can be increased without any of the disadvantages mentioned above.

If, according to the invention, the alkali metal silicate is added to the tower powder completely or, preferably, predominantly in the following mixing process, this agglomeration of the zeolite particles and hence deposition on the fabrics is surprisingly avoided, even in the absence of polymeric carboxylic acids and polyphosphonic or polyamino acids. The quantity of alkali metal silicate applied during the mixing process is preferably from 0.5 to 5% by weight and more preferably from 1 to 3% by weight (expressed as water-free), based on tower powder.

Another suitable washing alkali is, for example, sodium carbonate of which the percentage content may be up to 20% by weight and is preferably from 2 to 12% by weight and more preferably from 5 to 10% by weight.

The other constituents of the tower powder, of which the percentage content is from 0 to 60% by weight and preferably from 1 to 40% by weight, are for example optical brighteners, redeposition inhibitors (soil suspending agents), fabric softeners, dyes, neutral salts, such as sodium sulfate, and water.

The function of redeposition inhibitors is to keep the soil detached from the fibers suspended in the liquor and thus to prevent discoloration. Suitable redeposition inhibitors are, for example, cellulose ethers, such as carboxymethyl cellulose, methyl cellulose, hydroxyalkyl cellulose, and mixed ethers, such as methyl hydroxyethyl cellulose, methyl hydroxypropyl cellulose and methyl carboxymethyl cellulose. Other suitable redeposition inhibitors are mixtures of various cellulose ethers, more particularly mixtures of carboxymethyl cellulose and methyl cellulose or methyl hydroxyethyl cellulose. Their percentage content is preferably from 0.3 to 3% by weight.

Suitable fabric-softening additives are, for example, layer silicates from the class of bentonites and smectites, for example those according to DE 23 34 899 and EP 26 529. Other suitable fabric softeners are synthetic fine-particle layer silicates with a smectite-like crystal phase and reduced swelling power which correspond to the following formula:

$$MgO(M_2O)_a(Al_2O_3)_b(SiO_2)_c(H_2O)_n$$

in which

M is sodium, optionally together with lithium, with the proviso that the molar ratio of Na to Li is at least 2, a=0.05 to 0.4, b=0 to 0.3, c=1.2 to 2 and n=0.3 to 3, $(H_2O)_n$ standing for the water bound in the crystal phase. Synthetic layer silicates of the type characterized in detail in DE 35 26 405 are also suitable fabric softeners. The layer silicate content may be, for example, from 5 to 30% by weight.

Other suitable fabric softeners are long-chain fatty acid alkanolamides and dialkanolamides and reaction products of fatty acids or fatty acid diglycerides with 2-hydroxyethyl ethylenediamine and also quaternary ammonium salts containing 1 to 2 $C_{12-18}$ alkyl chains and 2 short-chain alkyl radicals or hydroxyalkyl radicals, preferably methyl radicals. These softeners are preferably added to the powder together with the nonionic surfactants in the mixer, for example in quantities of up to 10% by weight and preferably in quantities of 0.5 to 3% by weight, based on the tower powder.

The powders to be processed are spray-dried in known manner by spraying a slurry under high pressure by means of nozzles and passing hot combustion gases in countercurrent to the slurry in a drying tower.

In the interests of a high final density, the spray-dried powder leaving the drying tower (also referred to in short as "tower powder") should have an initial density (weight per liter) of at least 350 g/l. The tower powder preferably has a density of at least 400 g/l and, more particularly, at least 500 g/l. Tower powders of low specific gravity, for example those with a high zeolite content, can be compacted to a greater extent than those already having a relatively high initial density.

Basically, the tower powder does not have to meet any particular requirements in regard to its particle size and particle size distribution. On the contrary, powders with broad and narrow particle size distributions may be treated by the process. However, the tower powder should not be too fine, for example flour-like, but instead should have a particulate structure so that preferably at least 20% by weight and, more preferably, at least 50% by weight have an average particle diameter of 0.4 mm (sieve analysis). The effect of the process is that loose, voluminous constituents are compacted, constituents of irregular shape are rounded off and fines are compacted.

The powders leaving the tower may be immediately subjected to the process according to the invention. Basically, the temperature of the powder is not critical, particularly when the powder has been thoroughly dried, i.e. when its water content corresponds to or is less than the theoretical water binding capacity. However, in the case of plastic powders, more particularly powders of relatively high water content, it should be no higher than 50° C. and preferably no higher than 40° C., i.e. temperatures which are generally established when the powder is pneumatically transported. The powder may also be intermediately stored for long periods, although in general this is only of importance in the event of interruptions in production. A continuous flow of material is always advantageous, for which purpose the process according to the invention is particularly suitable.

In principle, any combined dryers/mixers which enable liquids to be uniformly applied to the particles and which do not have such a compacting effect that the particles agglomerate to a fairly significant extent during mixing are suitable for the process according to the invention. High-speed mixers are preferred, the speed of the mixing tools having to be adjusted in such a way that size-reduction of the individual particles of the tower powder is largely avoided. The exact conditions depend upon the internal structure of the mixer and are adapted to the strength of the tower powder and its ability rapidly to absorb liquids. Continuous mixing units are preferably used.

A mixing unit particularly suitable for carrying out the process according to the invention is described in European patent application 337 330. This mixing unit consists of an elongate mixing drum substantially cylindrical in shape which is mounted horizontally or sloping moderately downwards towards the horizontal and which is equipped with at least one feed inlet or hopper and with an outlet opening. Mounted inside the mixing unit is a central rotatable shaft which carries several radially arranged impact tools. During the rotation of the mixing unit, the impact tools are intended to be at a certain distance from the smooth inner wall of the drum. The length of the impact tools should be 80% to 98% and preferably 85% to 95% of the inner radius of the mixing drum.

The impact tools may assume any shape, i.e. they may be straight or angled, of uniform cross-section or tapered, rounded or widened at their ends. Their cross-section may be circular or angular with rounded corners. Tools of various shapes may also be combined with one another. Tools with a droplet-like to wedge-shaped cross-section, a flat or rounded surface facing in the direction of rotation, have been successfully used because with tools such as these the compacting effect predominates over the size-reducing effect. To avoid imbalances, the tools may be arranged diametrically in pairs or in a star-like configuration on the shaft. A spiral arrangement has proved to be of advantage. Although the number of tools is not critical, it is advisable in the interests of high efficiency to arrange them at intervals of 5 to 25 cm. It is also of advantage to mount them rotatably on the shaft, so that it is possible to influence the horizontal transport of the material being mixed by adjusting a flat lateral surface of the tools at an oblique angle in the direction of flow of the material. The configuration of the tools does not have to be uniform either; instead, it is possible to arrange tools with a more compacting and more transporting effect in alternation.

The transport of the material being mixed in the mixer can also be achieved or accelerated by additional transporting blades. These transporting blades may be arranged individually or in pairs between the mixing tools. The degree of transport may be regulated by the pitch angle of the blades.

Depending on the required throughput, the internal radius of the mixer is best between 10 and 60 cm and preferably between 15 and 50 cm while its internal length is between 70 and 400 cm and preferably between 80 and 300 cm, the ratio of internal length to internal radius being 4:1 to 15:1 and preferably 5:1 to 10:1. With dimensions such as these, the number of impact tools is normally between 10 and 100 and generally between 20 and 80. The inner wall of the cylinder should be smooth to avoid unwanted caking of the powder. With smaller dimensions, the rotational speed of the shaft—taking the Froude number into account—is above 800 r.p.m. (revolutions per minute) and generally between 1,000 and 3,000 r.p.m. With larger mixers, it may be reduced accordingly.

The residence time of the powder in the mixer depends upon the efficiency of the mixer and upon the intensity of the desired effect. In a preferred embodiment, it is no less than 10 seconds and no more than 60 seconds. More particularly, it is between 20 and 50 seconds. It may be influenced by the inclination of the mixer, by the shape and arrangement of the impact and transporting tools and, to a certain extent, also by the quantity of powder introduced and removed. Thus, a certain backing-up effect and, hence, an increase in the residence time of the powder in the mixer can be obtained by reducing the exit cross-section. The mixer should be operated in such a way that, after the warm-up period, a constant throughput of powder occurs, i.e. the quantity of powder introduced and the quantity of powder removed are always the same and constant.

A key measure for the operation of the mixer is the Froude number, a dimensionless number, which is defined by the following relation:

$$\frac{w^2 \cdot r}{g}$$

(w=angular speed, r=length of the tools from the central axis, g=earth's acceleration). The Froude number should be from 50 to 1,200, preferably from 100 to 800 and more preferably from 250 to 500.

Under the mechanical compounding effect, the powder can become slightly heated. However, additional cooling is generally not necessary and need only be provided in cases where the powder introduced tends to become tacky at elevated temperature. However, this problem can advantageously be solved by sufficiently cooling the tower powder beforehand, for example during its pneumatic transport.

The nonionic surfactant and the silicate solution are separately introduced into the mixer in the zone where the powder undergoes intensive mechanical compounding. It has proved to be of advantage in this regard to arrange the inlets in the mixer wall. At low rotational speeds, the otherwise typical arrangement of short spray nozzles in the hollow rotating shaft necessitates the use of spray nozzles which work under excess pressure or which are operated with compressed air on the principle of a perfume atomizer. This procedure necessitates additional outlay on pressure pumps and dust filters for the compressed air removed from the mixer. The arrangement in the mixer wall does not require any such investment. The liquids introduced are able to spread out on the inner wall and are continuously taken up by the powder impinging on the wall, distributed and adsorbed. If, for constructional reasons, the liquids have to be delivered through the hollow rotating shaft, the outlet nozzles arranged on the hollow shaft are advantageously extended to such an extent that they project into the stream of powder. By virtue of the increased centrifugal forces, the liquids can thus be transported and sprayed without compressed air, being subsequently distributed and taken up by the powder. The number of inlets is best between 1 and 10, the inlets preferably being positioned laterally in the vicinity of the ascending powder stream in cases where they are arranged in the cylinder wall. Where several inlets are arranged one behind the other, the last should be installed so far before the outlet opening that the issuing liquids are still homogeneously distributed.

The nonionic surfactant is delivered to the mixers in liquid form. Relatively high-melting compounds are melted beforehand and introduced at temperatures above the melting point. The transported powder also best has a minimum temperature which is in the vicinity of or above the melting point of the nonionic surfactant. This temperature range can readily be adjusted by suitably guiding the product after it has been spray dried.

The nonionic surfactant can thus be introduced as a whole into the powder. It is also possible to add only part of the nonionic surfactant to the material to be sprayed and only to introduce the remainder through the mixer. Basically, however, surfactants with a low degree of ethoxylation (low HLB value) should be incorporated solely through the mixer. The percentage content introduced through the tower powder is preferably not more than 50% by weight, based on the total content of nonionic surfactant in the end product. 0.5 To 10% by weight and, more particularly, 1 to 7% by weight of nonionic surfactant, based on tower powder, are preferably introduced in the mixer.

The solution of alkali metal silicate, which is applied to the powder separately from the nonionic surfactant in the mixer, should preferably be a concentrated solution. The solution may be introduced at the same time and the nonionic surfactant or even just before or after the nonionic surfactant. The quantity of silicate solution applied in the mixer is preferably in a ratio by weight of 2:1 to 1:2 to the nonionic surfactant applied. In one particularly preferred embodiment, substantially equal quantities by weight of both liquids are applied in the mixer.

The products leaving the mixer show excellent flow properties and do not have to be subjected to an after-treatment, more particularly subsequent drying. This applies even when relatively large quantities of nonionic surfactants— which on their own would lead to non-free-flowing or tacky particles—are used. For this reason, there is also no need additionally to incorporate dry moisture-adsorbing powders during the mixing process to reduce tackiness through surface accumulation of the powder on the particles. On the other hand, other solids, for example zeolite or finely powder inorganic salts which are to be combined with the tower powder, can of course also be added in the process according to the invention should this be desirable for other reasons.

The products obtained may be further processed immediately after leaving the mixer, i.e. they may be packed in transport containers or blended with other ingredients of the final detergent, such as bleaches (for example sodium perborate as monohydrate or tetrahydrate), bleach activators (for example granulated tetraacetyl ethylenediamine), enzyme granules and foam inhibitors (for example silicone or paraffin foam inhibitors applied to a carrier). It is of course also possible to treat two or more separately prepared tower powders of different composition together in the mixer or only to compact one of them and subsequently to incorporate a second.

EXAMPLES

A detergent tower powder was produced by spray drying in a conventional drying tower and was then transported by an airlift into a 2 $m^3$ capacity hopper above the mixing unit. The tower powder had the following composition (in % by weight):

| | |
|---|---|
| Sodium dodecyl benzenesulfonate | 12.5 |
| Oleyl/cetyl alcohol + 10 EO | 2.5 |
| Tallow soap | 1.7 |
| Zeolite NaA | 25.5 |
| Sodium silicate (1:3.35) | 3.9 |
| $Na_2CO_3$ | 16.8 |
| Brightener | 0.3 |
| Sodium sulfate + salts from raw materials | 26.3 |
| Maleic acid copolymer, Na salt | 3.5 |
| Water | 7.0 |

From the hopper, the tower powder with an average temperature of 40° C. was continuously delivered at a rate of around 80 to 100 kg per minute to a Lödige CB 60 mixer which was operated at a rotational speed of 850 r.p.m. Nonionic surfactant (coconut oil alcohol+3 EO) and waterglass solution ($Na_2O:SiO_2$=1:2, 35%) were introduced from below through injectors into the interior of the horizontally arranged cylindrical mixer, the nonionic surfactant being introduced through injectors 1 to 3 and the waterglass solution through injectors 4 to 6. The waterglass solution had a temperature of around 30° C. and the nonionic surfactant a temperature of around 40° C.

The mixing ratios in the individual tests and the also the apparent densities and sieve analyses of the products are set out in the following Table.

TABLE

| Example No. | Quantities (kg/min.) Tower powder | Surfactant | Silicate solution | Apparent density g/l | Particle size distribution (% by weight) >1.6 mm | >0.8 | >0.4 | >0.2 | >0.1 | <0.1 |
|---|---|---|---|---|---|---|---|---|---|---|
| 1 | 100 | — | — | 650 | 0.4 | 4.9 | 23.3 | 35.1 | 26.3 | 10.0 |
| 2 | 97 | 3 | — | 685 | 0.1 | 4.1 | 22.9 | 34.1 | 27.5 | 11.3 |
| 3 | 95 | 5 | — | 705 | 0.3 | 4.4 | 21.9 | 34.5 | 29.5 | 9.4 |
| 4 | 93 | 7 | — | 725 | 0.3 | 5.1 | 23.4 | 36.1 | 33.3 | 1.8 |
| 5 | 96 | 3 | 3 | 705 | 0.4 | 6.1 | 24.8 | 36.8 | 28.6 | 3.2 |
| 6 | 90 | 5 | 5 | 730 | 0.4 | 5.3 | 24.0 | 42.2 | 27.2 | 0.9 |
| 7 | 86 | 7 | 7 | 750 | 1.0 | 6.6 | 31.3 | 45.0 | 15.8 | 0.3 |
| Untreated tower powder | | | | 590 | 0.5 | 8.3 | 34.5 | 36.0 | 18.5 | 2.2 |

The figures shown in the Table clearly reflect the greater increase in apparent density where the nonionic surfactant and silicate solution are used together in Examples 5, 6 and 7 according to the invention.

In addition, it was found that the powders compacted solely with nonionic surfactant showed poor flow behavior (sluggish flow) beyond a charge of 5% by weight while all the powders produced in accordance with the invention flowed loosely and smoothly.

We claim:

1. A process for increasing the apparent density of a spray-dried detergent composition, comprising spraying said detergent composition with a liquid nonionic surfactant and an aqueous solution of an alkali metal silicate and mixing the mixture in a mixing unit.

2. The process as in claim 1 wherein said spray-dried detergent composition is simultaneously sprayed with said liquid nonionic surfactant and said aqueous solution of alkali metal silicate.

3. The process as in claim 1 wherein said spray-dried detergent composition is successively sprayed with said liquid nonionic surfactant and said aqueous solution of alkali metal silicate.

4. The process as in claim 1 wherein said mixing unit comprises a horizontally arranged mixing drum in which mixing elements rotate on a horizontal shaft.

5. The process as in claim 1 wherein said liquid nonionic surfactant and said aqueous solution of alkali metal silicate are introduced to said mixing unit through nozzles arranged in the wall of the drum of said mixing unit.

6. The process as in claim 1 wherein said detergent composition comprises a low-phosphate or phosphate-free composition.

7. The process as in claim 1 wherein said spray-dried detergent composition is sprayed with 0.5 to 10% by weight of said liquid nonionic surfactant and with 0.5 to 5% by weight of said aqueous solution of alkali metal silicate, based on the weight of said spray-dried detergent composition.

8. The process as in claim 1 wherein said liquid nonionic surfactant and said aqueous solution of alkali metal silicate are sprayed on said spray-dried detergent composition in a weight ratio of 2:1 to 1:2.

9. The process as in claim 1 wherein said alkali metal silicate is of the formula $Na_2O:SiO_2$=1:1 to 1:3.5.

10. The process as in claim 1 wherein said spray-dried detergent composition comprises from 0.5 to 5% by weight anionic surfactant, 15 to 70% by weight builder, 0 to 10% by weight nonionic surfactant and 0 to 60% by weight conventional detergent ingredients capable of being spray-dried at elevated temperatures.

11. The process as in claim 1 wherein said spray-dried detergent composition has an initial density of at least 350 g./l.

12. The process as in claim 1 wherein said spraying step and said mixing step are both conducted in said mixing unit.

* * * * *